US011585109B2

(12) United States Patent
Eckhardt et al.

(10) Patent No.: US 11,585,109 B2
(45) Date of Patent: Feb. 21, 2023

(54) LIFEGUARD OBSERVATION STATION

(71) Applicant: AQUA CONSCIENCE HOLDINGS LLC, Lancaster, PA (US)

(72) Inventors: Bartley J. Eckhardt, Lancaster, PA (US); Bret W. Johnson, Lancaster, PA (US)

(73) Assignee: AQUA CONSCIENCE HOLDINGS LLC, Lancaster, PA (US)

( * ) Notice: Subject to any disclaimer, the term of this patent is extended or adjusted under 35 U.S.C. 154(b) by 0 days.

(21) Appl. No.: 17/401,590

(22) Filed: Aug. 13, 2021

(65) Prior Publication Data

US 2021/0372150 A1 Dec. 2, 2021

Related U.S. Application Data

(63) Continuation-in-part of application No. 16/905,220, filed on Jun. 18, 2020.

(60) Provisional application No. 62/865,341, filed on Jun. 24, 2019.

(51) Int. Cl.

| | |
|---|---|
| ***E04H 1/12*** | (2006.01) |
| ***E04F 11/025*** | (2006.01) |
| ***E04H 4/14*** | (2006.01) |

(52) U.S. Cl.

CPC ..... *E04H 1/1205* (2013.01); *E04F 11/025* (2013.01); *E04H 4/14* (2013.01)

(58) Field of Classification Search

CPC .... E04H 1/1205; E04B 1/3412; A01M 31/02; E04F 11/032

See application file for complete search history.

(56) References Cited

U.S. PATENT DOCUMENTS

2007/0199258 A1* 8/2007 Reeves ..... E04F 11/0255 52/183
2008/0236066 A1 10/2008 Arnold
2017/0342719 A1* 11/2017 Seo ..... E04F 11/032

* cited by examiner

*Primary Examiner* — Gisele D Ford
(74) *Attorney, Agent, or Firm* — Potomac Law Group, PLLC; Bruce Wolstoncroft

(57) ABSTRACT

A lifeguard observation station having a support structure for allowing a lifeguard to monitor a pool and swimmers or bathers therein. The lifeguard observation station includes a platform which is configured to accommodate the lifeguard. The platform member has a first edge, with at least a portion of the first edge of the platform member and a portion of the platform member adjacent the first edge being configured to extend to or beyond a pool edge of the pool. When positioned on the portion of the platform member adjacent the first edge, the lifeguard is positioned at the edge of the water or over the water in the pool to provide the lifeguard an unimpaired line-of-sight to the swimmers or bathers in the pool.

13 Claims, 6 Drawing Sheets

LIFEGUARD OBSERVATION STATION

CROSS REFERENCE TO RELATED APPLICATIONS

This application is a Continuation-in-Part of and claims priority to U.S. application Ser. No. 16/905,220 filed on Jun. 18, 2020, entitled Lifeguard Observation Station, and U.S. Application No. 62/865,341 filed on Jun. 24, 2019, entitled Lifeguard Observation Station, both of which are incorporated herein by reference in their entirety.

FIELD OF THE INVENTION

The present invention relates generally to an observation platform for use by a lifeguard at a swimming pool. More particularly, the invention is directed to an observation platform which provides maximum visibility of swimmers or bathers in the pool when a lifeguard is positioned on the platform and when the lifeguard is exiting the platform.

BACKGROUND OF THE INVENTION

Lifeguard chairs are used at pools and beaches to allow a lifeguard to sit and observe individuals swimming or recreating in or near the water and to safely effectuate a rescue of a swimmer or bather in distress. Generally, a lifeguard chair includes a raised platform with a seat attached thereto. The seat allows the user to be positioned approximately 4 to 10 feet above the ground. A ladder may be used as part of the chair to allow the lifeguard to access the seat.

In some uses, the lifeguard chair is permanently affixed to the ground. For smaller pools and other environments, however, the lifeguard chair is portable. A frame of the lifeguard chair supports the chair and generally has a sufficiently wide base to provide support on the pool deck or other surface.

In general, lifeguard chairs are configured to provide a chair at the top of a ladder or stairs. Such configurations allow for little or no ability for the lifeguard to stand or move relative to the chair, thereby limiting the ability of the lifeguard to properly observe the individual swimmers in all locations of the pool or body of water. The ladder or stairs, or lack thereof, often pose the risk of a fall of the lifeguard, especially when attempting to effectuate a rescue. In addition, the positioning of the chair is often set back from the edge of the pool or body of water, as room is required for access or egress. Consequently, as the chair and the lifeguard are removed from the edge of the pool or body of water, the lifeguard's line of sight is not optimized, leaving areas of the pool or body of water not visible to the lifeguard.

Another problem with many lifeguard chairs is that they can tip over in foreseeable use, including in high winds. A falling chair can be dangerous for a lifeguard using the chair or for individuals around the chair when the chair falls over. In addition, the chair may be damaged if it tips over in the wind.

It would be beneficial to provide a lifeguard observation station which can be positioned at the edge of the pool or body of water and which provides the lifeguard with up to 360 degree visibility of swimmers or bathers in the pool when the lifeguard is positioned on the platform. It would also be beneficial to provide the lifeguard with maximum visibility of swimmers or bathers when the lifeguard is exiting the platform, thereby allowing the lifeguard to maintain a line-of-sight to any swimmer or bather in distress. It would also be beneficial to provide a lifeguard observation station which is portable and stable, and offers safe access and egress to and from the platform.

SUMMARY OF THE INVENTION

An object of the invention is to provide a lifeguard observation station which provides the lifeguards with maximum visibility of the swimmers or bathers in a pool to prevent drowning incidents.

An embodiment is directed to a lifeguard observation station for allowing lifeguards to monitor a pool and swimmers or bathers therein. The lifeguard observation station includes a platform which is configured to accommodate the lifeguard. The platform member has a first edge, with at least a portion of the first edge of the platform member and a portion of the platform member adjacent the first edge being configured to extend beyond a pool edge of the pool. When positioned on the portion of the platform member adjacent the first edge, the lifeguard is positioned over the water in the pool to provide the lifeguard an unimpaired line-of-sight to the swimmers or bathers in the pool, including those near the pool edge adjacent to the lifeguard observation station.

An embodiment is directed to a movable lifeguard observation station for allowing a lifeguard to monitor a swimming pool and swimmers or bathers therein. The movable lifeguard observation station includes a raised platform which is configured to accommodate the lifeguards. The raised platform has a first edge, with at least a portion of the first edge of the platform member and a portion of the raised platform adjacent the first edge being configured to extend at or beyond a pool edge of the swimming pool. The first edge and the portion of the raised platform adjacent the first edge extends at or over the water in the swimming pool. Stairs extend from the raised platform to a deck of the swimming pool. The lifeguard observation station provides the lifeguard an unimpaired line-of-sight to the swimmers or bathers in the swimming pool whether the lifeguard is positioned on the raised platform or on the stairs.

An embodiment is directed to a lifeguard observation station, for allowing a lifeguard to monitor a swimming pool and swimmers or bathers therein. The lifeguard observation station includes a raised platform which is configured to accommodate the lifeguard. The raised platform has a first edge, with at least a portion of the first edge of the raised platform and a portion of the raised platform adjacent the first edge being configured to extend at or beyond a pool edge of the swimming pool. The first edge and the portion of the raised platform adjacent the first edge extends at or over the water in the swimming pool to provide the lifeguard an unimpaired line-of-sight to the swimmers or bathers in the pool. Stairs extend from the raised platform to a deck of the swimming pool. A base extends from the deck of the swimming pool to the raised platform. The base is offset from the stairs to allow the lifeguard to have a line-of-sight to the swimmers or bathers in the swimming pool as the lifeguard is descending the stairs.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
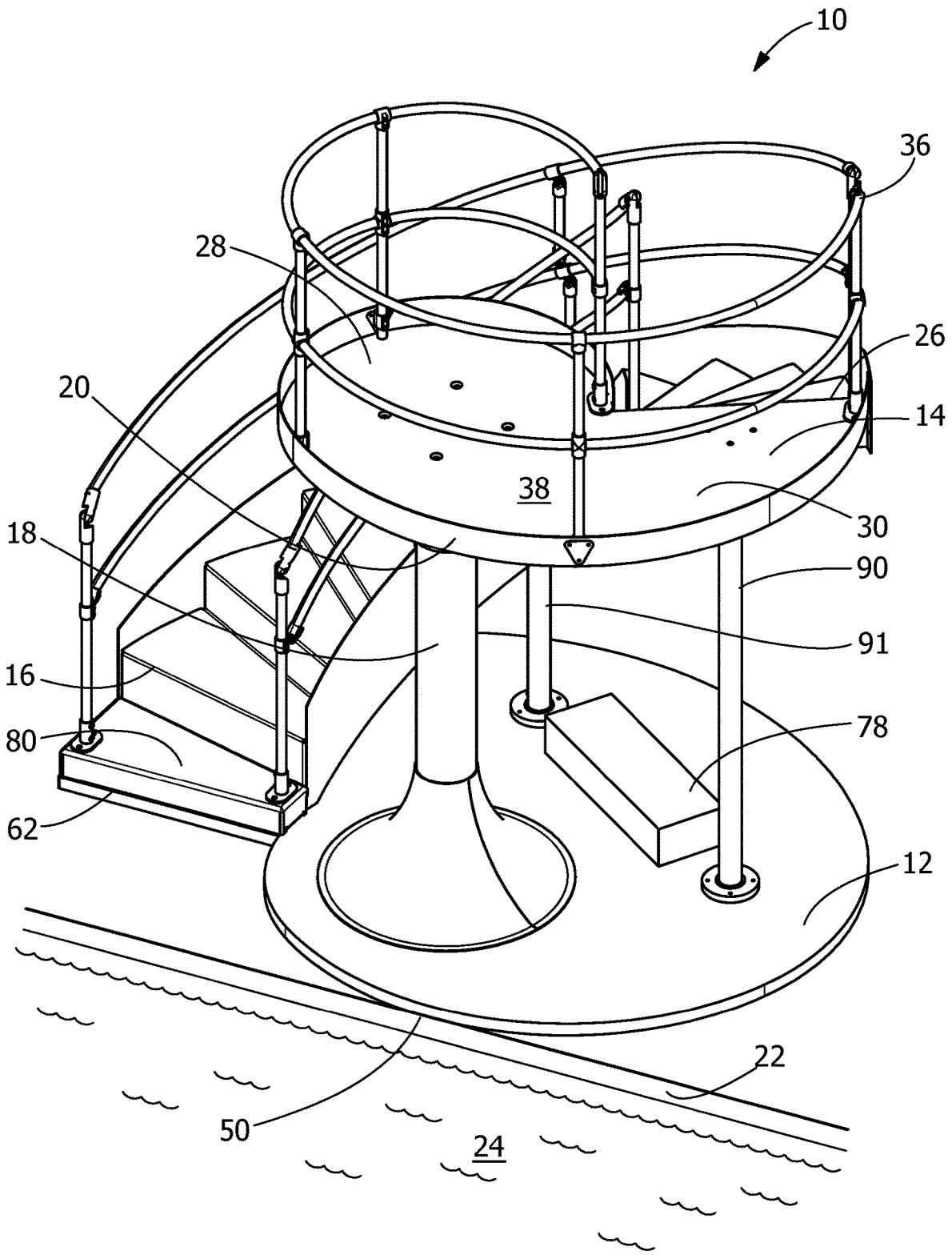
FIG. 1 is a front perspective view of an illustrative embodiment of a lifeguard observation station positioned proximate an edge of a pool or body of water.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

As shown in FIGS. 1-7, an illustrative embodiment of a lifeguard observation station 10 according to the present invention has a base member 12, a platform member 14, stairs 16 and a support member 18. The platform member 14 is positioned above the base member 12.

The platform member 14 has a first side 20, with at least a portion of the first side 20 of the platform member 14 being configured to be positioned proximate to or in-line with an edge 22 of a pool or body of water 24. The platform member 14 has a second side 26 from which the stairs 16 extend. In the embodiment shown, the second side 26 is opposed to the first side 20. However, the second side 26 may be positioned at different orientations relative to the first side 20, allowing the stairs to extend from other directions of the platform member 14.

Figure 5:
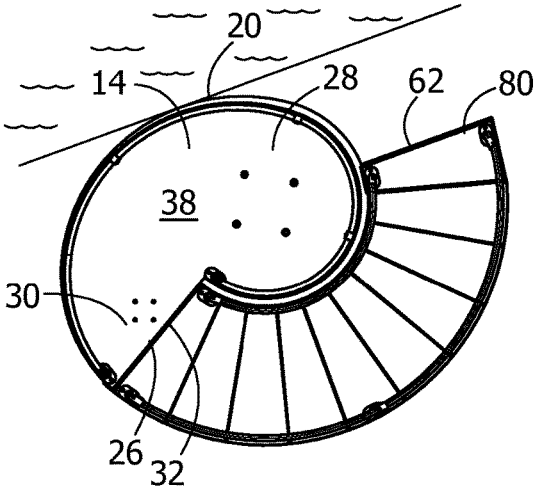
FIG. 5 is a top view of the lifeguard observation station of FIG. 1.
Figure 6:
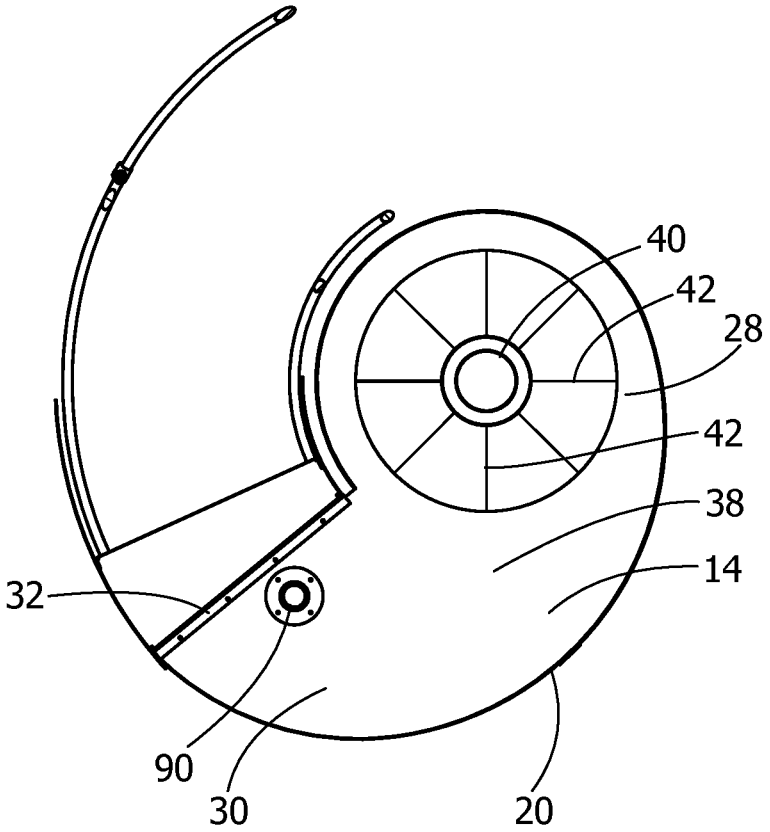
FIG. 6 is cross-section view of the lifeguard observation station taken along line 6-6 of FIG. 3.

In the embodiment shown, the platform member 14 has a volute shape, as best viewed in FIG. 5. The volute shape allows the platform member 14 to have a generally circular or elliptical portion 28 with an extension portion 30 extending from the circular or elliptical portion 28. The extension portion 30 has a generally straight surface 32 from which the stairs 16 extend.

A chair (not shown) may be provided on the platform member 14 to allow a lifeguard positioned in the lifeguard observation station 10 to be seated. The chair may be, but is not limited to, a swivel chair or a lean chair. The chair may be positioned proximate the center of the circular or elliptical portion 28. However, in other embodiments, no chair or more than one chair may be provided.

The circular or elliptical portion 28 of the platform member 14 has a sufficient surface area to allow the lifeguard to move about the platform member 14 to allow the lifeguard to acquire an optimum line-of-sight to the pool or body of water 24.

The platform member 14 has a railing 36 provided about the circumference thereof. The railing 36 does not extend across the straight surface 32 of the second side 26, thereby allowing the lifeguard to access the stairs 16 which extend from the straight surface 32. The railing 36 is of sufficient height to prevent the lifeguards from falling from the platform member 14. In addition, the railing 36 is constructed in a manner to provide sufficient safety support while providing unobstructed line-of-sight of the pool or body of water 24, yet preventing the lifeguard from entering the water directly from a hazardous height and/or into a hazardous water depth or condition.

Figure 2:
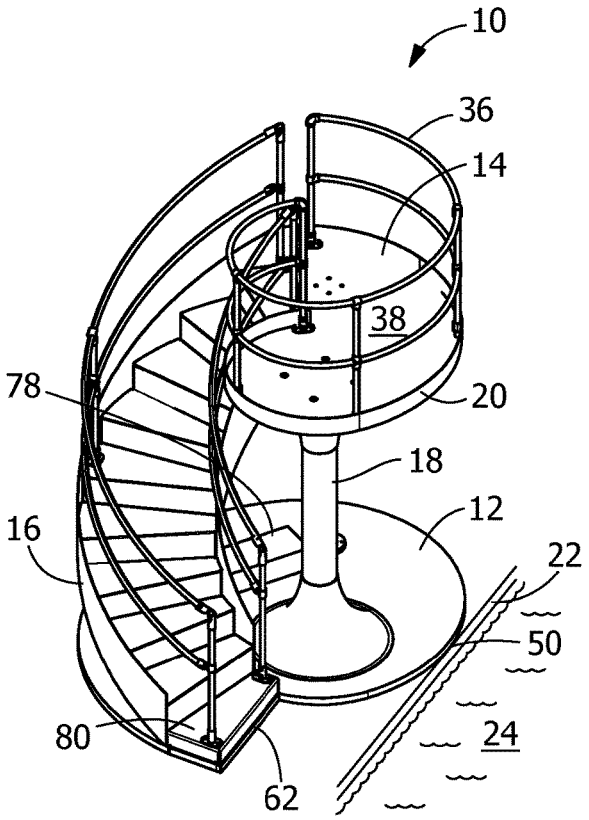
FIG. 2 is a side perspective view of the lifeguard observation station of FIG. 1 positioned proximate an edge of a pool or body of water.
Figure 3:
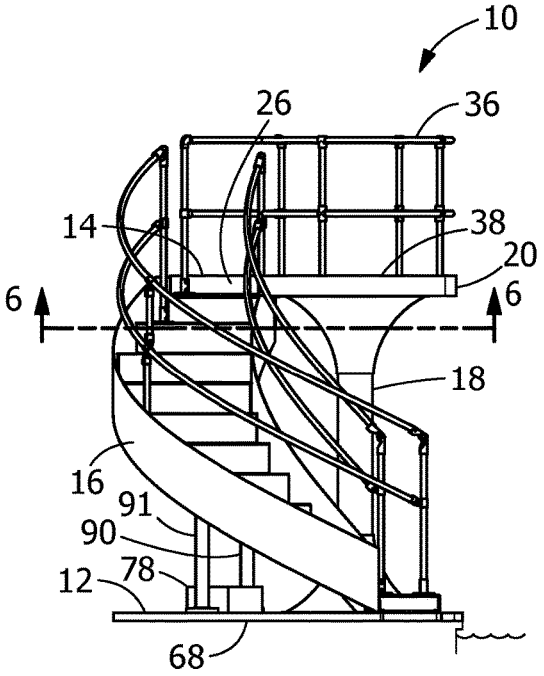
FIG. 3 is a side view of the lifeguard observation station of FIG. 1.
Figure 4:
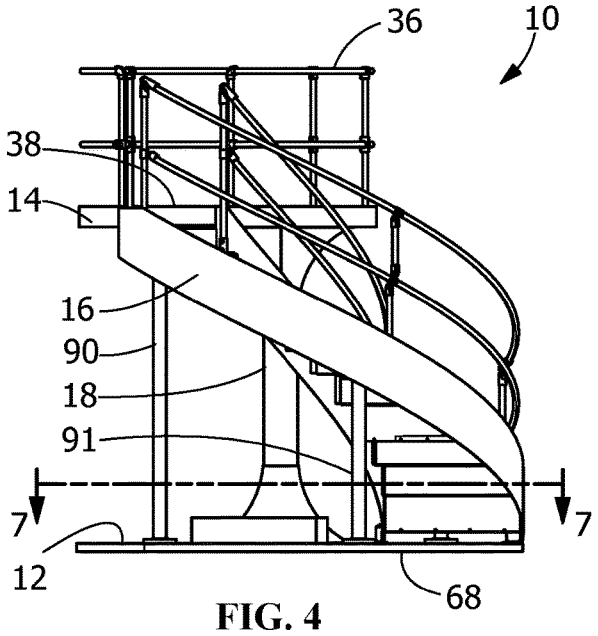
FIG. 4 is back view of the lifeguard observation station of FIG. 1.

As previously stated, at least a portion of the first side 20 of the platform member 14 is configured to be positioned proximate to or in-line with an edge 22 of a pool or body of water 24, as best shown in FIGS. 1 and 2. This allows the lifeguard to have a line-of-sight of the pool or body of water 24, including directly at the edge 22 of a pool or body of water 24, eliminating the blind spot at the edge 22 of a pool or body of water 24 associated with known lifeguard stations.

The positioning of lifeguards is a critical factor that contributes to lifeguard effectiveness in preventing injuries and responding to drownings at public swimming pools and water parks. If the lifeguards cannot see all of the bathers in the water, the lifeguards cannot effectively supervise and protect the bathers. The Lifesaving Society's Public Aquatic Facility Safety Standards state: "The supervision position(s) of lifeguards must be designed to eliminate blind spots in the pool area. It must be possible for the lifeguard team to observe all bathers in the pool area."

As the proper number and positioning of lifeguards has a significant potential to reduce the risk of drowning, the lifeguard observation station is configured to allow the platform member 14 to be positioned in-line with the edge 22 of the pool or body of water 24 to provide the lifeguards with proper views of the pool, including the edge 22 of a pool or body of water 24 proximate to which the lifeguard observation station 10 is positioned.

The platform member 14 has a platform or deck 38 upon which the lifeguard is positioned. As viewed in FIG. 6, a securing member or support post 40 extends from the deck 38. Reinforcing members 42 extend radially from the support post 40 to provide sufficient support to the deck 38 to support one or more lifeguards. The support post 40 and reinforcing members 42 can be made from any material having the strength characteristics required to support the deck 38 and lifeguards. While the support post 40 and reinforcing members 42 form a generally conical configuration, other configurations of the support post 40 and reinforcing members 42 can be used without departing from the scope of the invention. In addition, in alternate illustrative embodiments, the support member 18 may be fixed, such as, for example, the support post 40 extends from the ground or pool deck and is set in concrete.

The base member 12 has a first side 50, with at least a portion of the first side 50 of the base member 12 being configured to be positioned proximate to or in-line with the edge 22 of the pool or body of water 24. In the illustrative embodiment shown, the stairs 16 also extend from a portion of the first side 50 of the base member 12. However, other configurations, in which the stairs extend from other sides and other directions of the base member 12 may be used without departing from the scope of the invention.

Figure 7:
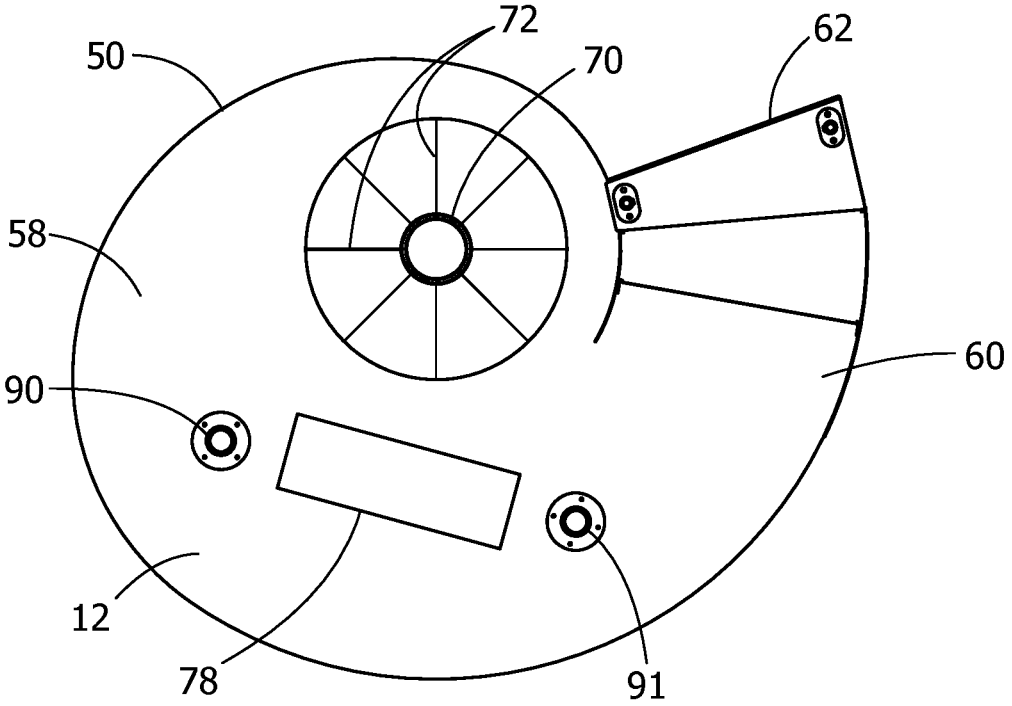
FIG. 7 is cross-section view of the lifeguard observation station taken along line 7-7 of FIG. 4.

In the embodiment shown, the base member 12 has a volute shape, as best viewed in FIG. 7. The volute shape allows the base member 12 to have a generally circular or elliptical portion 58 with an extension portion 60 extending from the circular or elliptical portion 58. The extension portion 60 has a generally straight surface 62 from which the stairs 16 extend. The straight surface 62 extends in a plane which is essentially parallel to a plane of the edge 22 of the pool or body of water 24 which is proximate to the lifeguard observation station 10. While the base member 12 is positioned below the platform 24, the volute shape of the base member 12 and the straight surface 62 of the base member 12 are not positioned in-line with the volute shape of the platform 14 and the straight surface 32 of the platform 14.

The base member 12 has a larger surface area than the surface area of the platform member 14, allowing the base member 12 to properly support and provide stability to the platform member 14 and stairs 16 to allow the lifeguard to move about the platform member 14 without causing the platform to tip or become unstable.

The first side 50 of the base member 12 is configured to be positioned in-line or offset from the first side 20 of the platform member 14 in a direction away from the edge 22 of the pool or body of water 24. This allows the first side 20 of the platform member 14 to be positioned proximate to or in-line with the edge 22 of the pool or body of water 24, as previously described and as best shown in FIG. 1.

Figure 8:
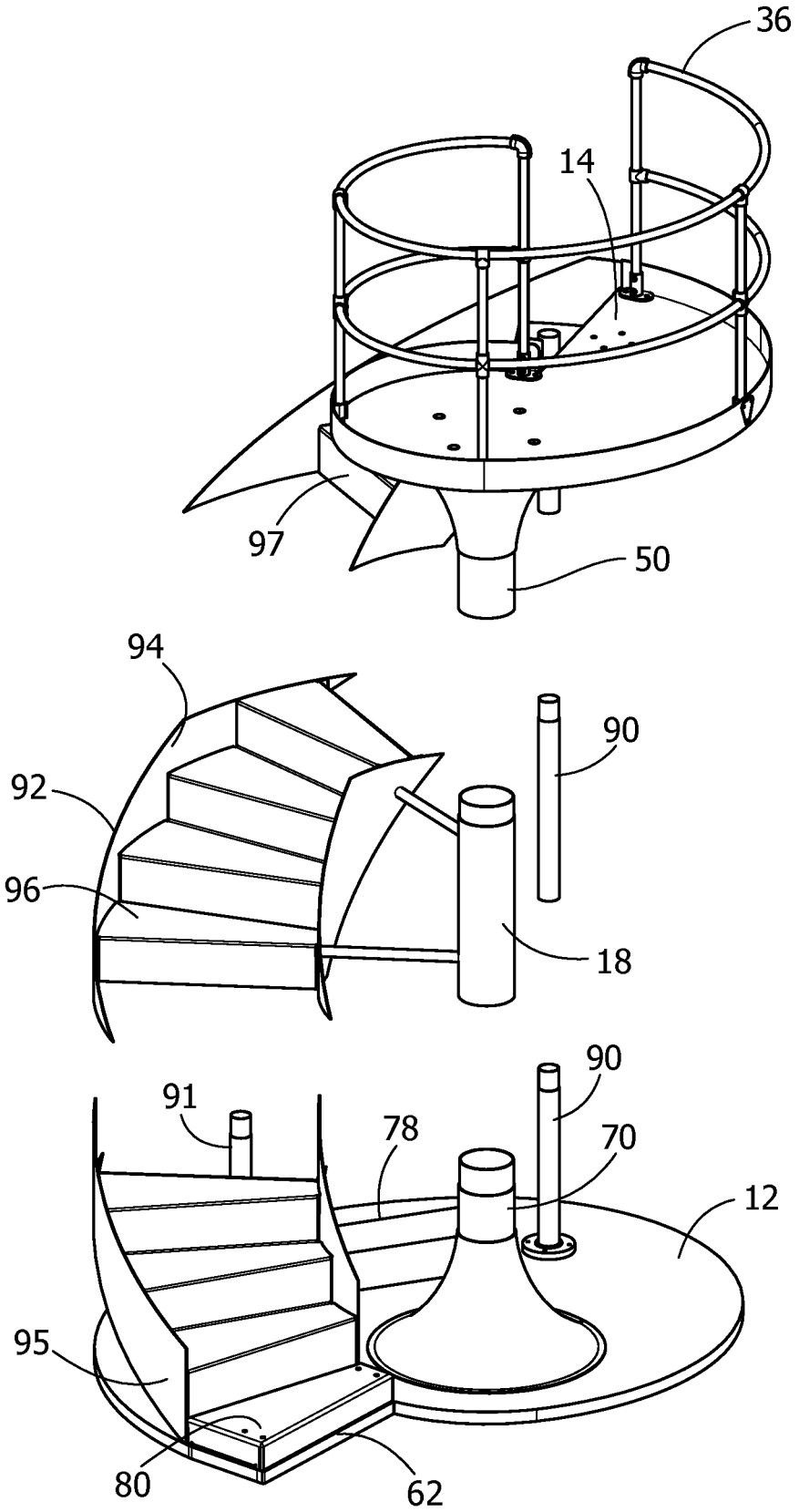
FIG. 8 is an exploded perspective view of a first alternate illustrative embodiment of a lifeguard observation station.

Referring to FIGS. 7 and 8, the base member 12 has a bottom platform 68 which is configured to be positioned on the ground or pool deck. As best shown in FIG. 7, a securing member or support post 70 extends from the bottom platform 68. Strengthening members 72 extend radially from the support post 70 to the bottom platform 68 to provide sufficient support to the post 70. The support post 70 and strengthening members 72 provide sufficient support to stabilize the platform member 14 and support one or more lifeguards positioned thereon. The support post 70 and strengthening members 72 can be made from any material having the strength characteristics required to stabilize the platform member 14 and the lifeguard observation station 10. While the support post 70 and strengthening members 72 form a generally conical configuration, other configurations of the support post 70 and strengthening members 72 can be used without departing from the scope of the invention.

Wheels (not shown) may be provided on the bottom platform 68 of the base member 12 to facilitate the movement of the base member 12 and the lifeguard observation station 10 to the proper position. The wheels may be spring loaded to allow the base member 12 to be moved or to be maintained in position when desired.

Additional weight or ballast(s) 78 may be added to the base member 12 to provide additional weight to further stabilize the base member 12 and the lifeguard observation station 10. One example of a ballast 78 is a hollow tank adapted to hold water or a similar liquid mass. Another example is a solid disk having suitable mass. Upon proper positioning of the base member 12, the ballast 78 may be filled to stabilize the lifeguard observation station 10.

The support member or post 18 extends between the base member 12 and the platform member, as shown in FIGS. 1 and 2. The support member is aligned with and in physical contact with the support post 40 of the platform member 14 and the support post 70 of the base member 12. The support member/post 18 can be a separate modular component of the lifeguard observation station 10 which connects to the modular base member 12 and the modular platform member 14. Alternatively, the support member 18 may be integrally attached to the support post 70 of the base member 12 and the support post 40 of the platform member 14. The support member 18 shown in the illustrative embodiment is a cylindrical pipe like member made of any material having the strength characteristics required to support the platform member 14 and stabilize the lifeguard observation station 10.

The support member 18 may be varied in size depending upon the height required for the deck 38 of the platform member 14. For example, in the embodiment shown in FIGS. 1-7, the support member 18 is longer in length than the support member 18 shown in FIG. 8.

Additional support members 90 may also extend between the platform member 14 and the base 12. The support members 90 provide additional support to the platform member 14 and stabilize the lifeguard observation station 10. In the embodiment shown, the additional support members 90 are cylindrical members with a smaller diameter than the diameter of the support post 40 of the support member 18. However, other configurations of the support members 90 may be used without departing from the scope of the invention. The support members 90 can be made from any material having the strength characteristics required to stabilize the platform member 14.

The stairs 16 extend between the base member 12 and the platform member, as shown in FIGS. 1 and 2. The stairs 16 have a generally spiral configuration. The stairs 16 may be supported by the engagement of the stairs with the extension 60 of the base member 12 and the extension 30 of the platform member 14.

Additional support members 91 may also extend between the stairs 16 and the base 12. The support members 91 provide additional support to the stairs 16 and stabilize the lifeguard observation station 10. In the embodiment shown, the additional support members 91 are cylindrical members with a smaller diameter than the diameter of the support post 18. However, other configurations of the support members 91 may be used without departing from the scope of the invention. The support members 91 can be made from any material having the strength characteristics required to stabilize the stairs 16.

The stairs 16 may be of different height depending upon the overall height of the observation station 10. In addition, the stairs 16 may have modular sections which allow the height of the stairs 16 to be proportional to the height of the support post 18 which extends between the platform member 14 and the base member 12. In various embodiments, and as shown in FIG. 8, a riser section 92 is positioned between the base member 12 and the platform member 14, the riser section 92 has an intermediate portion 96 of the stairs 16 secured to the support post 18. When the riser section 92 is positioned between the base member 12 and the platform member 14, the upwardly projecting securing member 70 of the base member 12 cooperates with the support post 18 and the downwardly projecting securing member 50 of the platform member 14 cooperates with the riser support post 18 to allow the platform member 14 to be properly secured to the support post 18 of the riser section 92 and the support post 18 of the riser section 92 to be properly secured to the base member 12, causing a lower portion 95 of the stairs 16, the intermediate portion 96 of the stairs 16 and an upper portion 97 of the stairs 16 to form the continuous stair case.

A bottom stair 80 extends from the straight surface 62 of the extension 60 of the base member 12. A top stair 82 extends from the straight surface 32 of the extension 30 of the platform member 14. The bottom stair 80 is positioned such that a longitudinal axis or a longitudinal edge of the bottom stair 80 is essentially parallel to the edge 22 of the pool or body of water 24 at which the lifeguard observation station member is positioned.

When viewed from the edge 22 of the pool or body of water 24, the stairs 16 are offset from the support member 18 to allow a lifeguard using the stairs to have unobstructed line-of-sight of the pool or body of water 24 as the lifeguard descends the stairs 16 from the platform member 14.

Continuous and unimpaired observation of the pool or body of water 24 are critical as the lifeguard is descending from the deck 38 of the platform member 14 to the edge 22 of the pool or body of water 24. Such unimpaired line-of-sight can be critical to allow a lifeguard to maintain a continuous vision of an impaired swimmer. In addition, the safety of the lifeguard ascending and descending the from the deck 38 are essential. The lifeguard observation station 10, and in particular, the stairs 16 are OSHA compliant.

As shown in FIGS. 9 through 12, an alternate illustrative embodiment of a lifeguard observation station 110, according to the present invention, has a base member 112, a platform member 114, and stairs 116. Portions of the platform member 114 are positioned above the base member 112.

The platform member 114 has a first side 120 with a curved or arcuate configuration. At least a portion 121 of the first side 120 of the platform member 114 is configured to extend to or beyond an edge 122 of a pool or body of water 124. The platform member 114 has a second side 126 from which the stairs 116 extend. In the embodiment shown, the second side 126 is opposed to the first side 120. However, the second side 126 may be positioned at different orientations relative to the first side 120, allowing the stairs to extend from other directions of the platform member 114.

Figure 9:
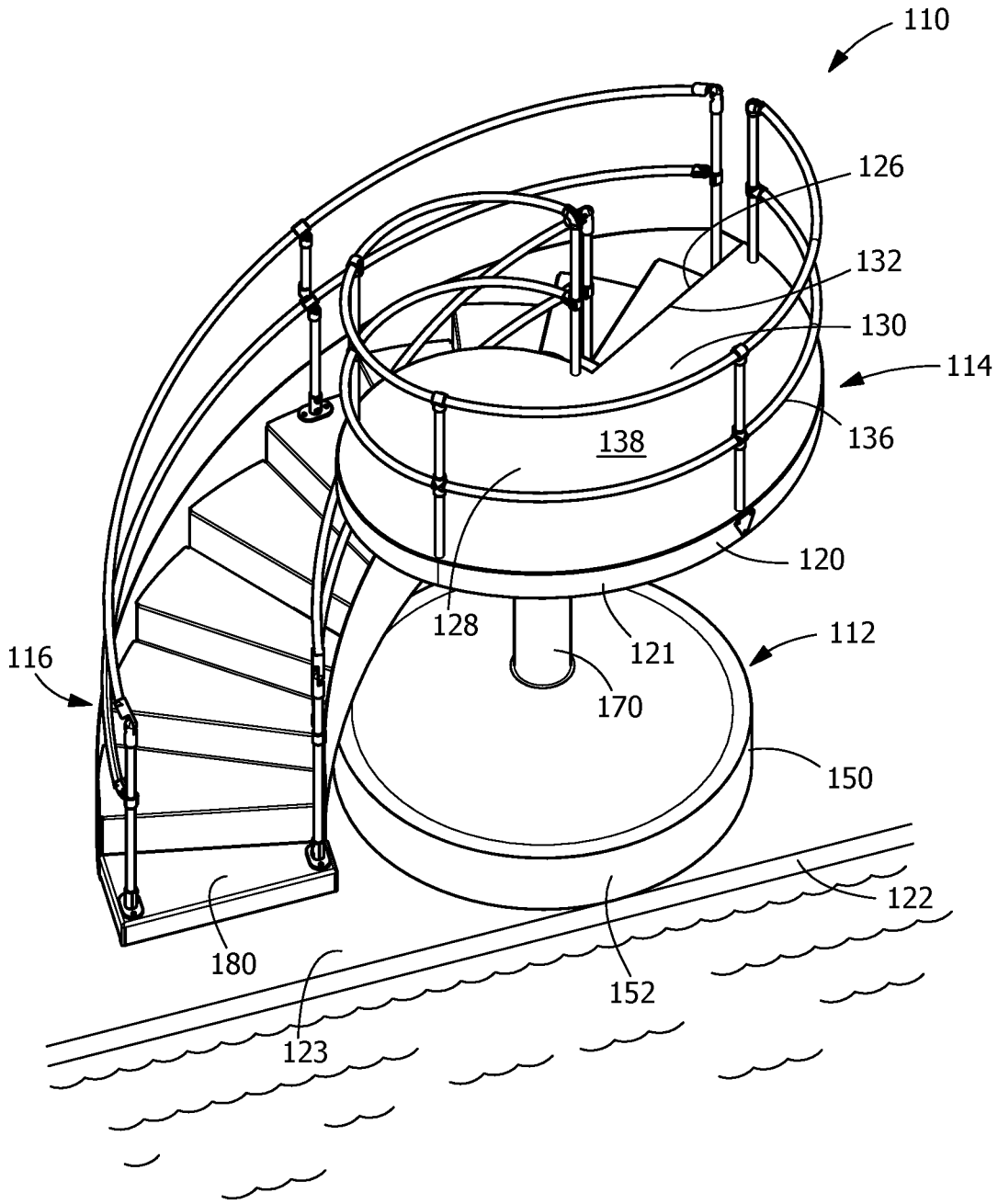
FIG. 9 is a front perspective view of a second alternate illustrative embodiment of a lifeguard observation station positioned proximate the edge of a pool or body of water.
Figure 13:
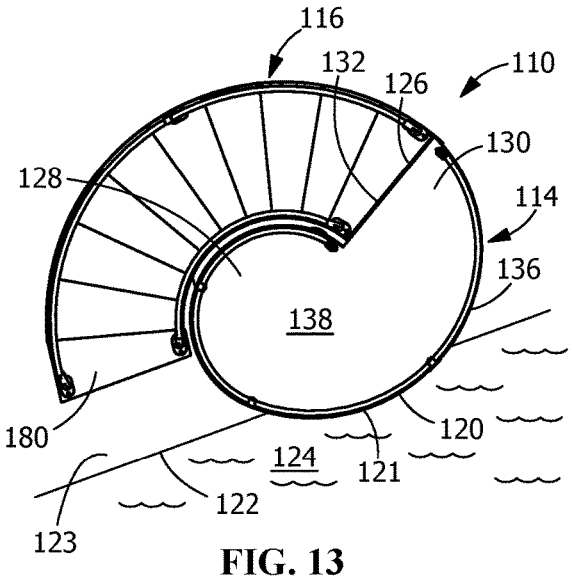
FIG. 13 is a top view of the lifeguard observation station of FIG. 9.

In the embodiment shown, the platform member 114 has a volute shape, as shown in FIGS. 9 and 13. The volute shape allows the platform member 114 to have a generally circular or elliptical portion 128 with an extension portion 130 extending from the circular or elliptical portion 128. The extension portion 130 has a generally straight surface 132 from which the stairs 116 extend.

The circular or elliptical portion 128 of the platform member 114 has a sufficient surface area to allow the lifeguard to move about the platform member 114 to allow the lifeguard to acquire an optimum line-of-sight to the pool or body of water 124.

The platform member 114 has a platform or deck 138 upon which the lifeguard is positioned. The platform member 114 has a railing 136 provided about the circumference thereof. The railing 136 does not extend across the straight surface 132 of the second side 126, thereby allowing the lifeguard to access the stairs 116 which extend from the straight surface 132. The railing 136 is of sufficient height to prevent the lifeguards from falling from the platform member 114. In addition, the railing 136 is constructed in a manner to provide sufficient safety support while providing unobstructed line-of-sight of the pool or body of water 124. While the railing 136 is shown, different shapes and configurations of railing may be used, including, but not limited to, plastic or tempered glass.

As previously stated, at least a portion 121 of the first side 120 of the platform member 114 is configured to extend to or over the edge 122 of the pool or body of water 124, as shown in FIGS. 9, 10, 11 and 13. This allows the lifeguard positioned proximate to the portion 121 of the first side 120 to have a line-of-sight of the pool or body of water 124, including directly at the edge 122 of a pool or body of water 124, eliminating the blind spot at the edge 122 of a pool or body of water 124 associated with known lifeguard stations.

The positioning of lifeguards is a critical factor that contributes to lifeguard effectiveness in preventing injuries and responding to drownings at public swimming pools and water parks. If the lifeguards cannot see all of the bathers in the water, the lifeguards cannot effectively supervise and protect the bathers. The Lifesaving Society's Public Aquatic Facility Safety Standards state: "The supervision position(s) of lifeguards must be designed to eliminate blind spots in the pool area. It must be possible for the lifeguard team to observe all bathers in the pool area."

As the proper number and positioning of lifeguards has a significant potential to reduce the risk of drowning, the lifeguard observation station 110 is configured to allow the platform member 114 to extend over the edge 122 of the pool or body of water 124 to provide the lifeguards with proper views of the pool, including the edge 122 of the pool or body of water 124 proximate to which the lifeguard observation station 110 is positioned.

In the illustrative embodiment shown in FIGS. 9 through 13, the base member 112 has a generally circular configuration. A portion 152 of an edge 150 of the base member 112 is configured to be positioned proximate to or in-line with the edge 122 of the pool or body of water 124. The portion 152 of the edge 150 of the base member 112 is offset from the portion 121 of the first side 120 of the platform member 114, thereby allowing the portion 121 of the first side 120 of the platform member 114 to extend to or over the edge 122 of the pool or body of water 124 when the portion 152 of an edge 150 of the base member 112 is positioned proximate to or in-line with the edge 122 of the pool or body of water 124.

While the base member 112 has a smaller surface area than the surface area of the platform member 114, the base member 112 is weighted to allow the base member 112 to properly support and provide stability to the platform member 114 and stairs 116, thereby allowing the lifeguard to move about the platform member 114 without causing the platform to tip or become unstable.

Additional weight or ballast(s) (not shown) may be added to the base member 112 to provide additional weight to further stabilize the base member 112 and the lifeguard observation station 110. One example of a ballast is a weighted disk shaped member which can be positioned internally in the base member 112.

The base member 112 includes a securing member or support post 170 which extends to the platform member 114 to properly support the platform member 114 in the raised position. The support post 170 provides sufficient support to stabilize the platform member 114 and support one or more lifeguards positioned thereon. The support post 170 can be made from any material having the strength characteristics required to stabilize the platform member 114 and the lifeguard observation station 110. In addition, in alternate illustrative embodiments, the support post 170 may be fixed, such as, for example, the support post 170 extends from the ground or pool deck and is set in concrete.

Wheels (not shown) may be provided on the base member 112 to facilitate the movement of the base member 112 and the lifeguard observation station 110 to the proper position. The wheels may be spring loaded to allow the base member 112 to be moved or to be maintained in position when desired. Other types of mechanisms which allow the wheels to engage the ground, surface or deck 123 may be used.

The stairs 116 extend from the platform member 114 to the deck 123 of the pool 124. The stairs 116 have a generally spiral configuration. The stairs 116 may be supported by support members (not shown). In various embodiments, the support members may be attached to the stairs 116 and the support post 170 and/or the base 112 to provide proper positioning and stability to the stairs 116. The stairs 116 may be of different height depending upon the overall height of the observation station 110.

Figure 10:
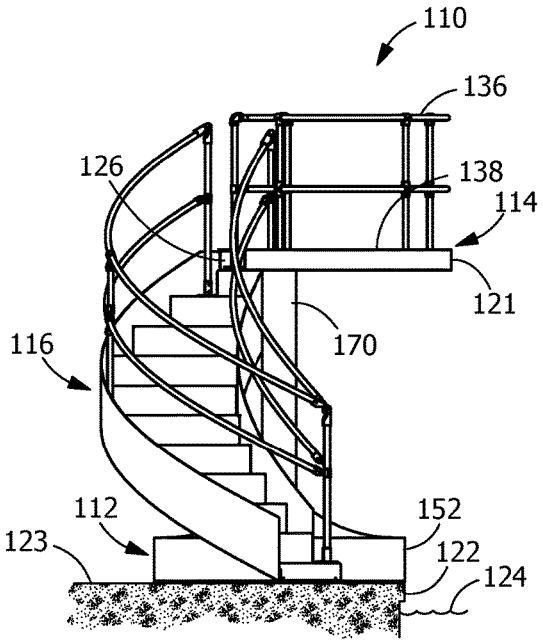
FIG. 10 is a left side view of the lifeguard observation station of FIG. 9.
Figure 11:
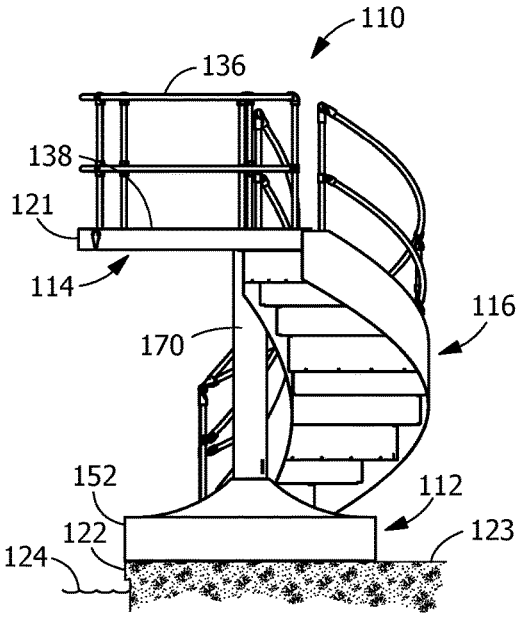
FIG. 11 is a right side view of the lifeguard observation station of FIG. 9.
Figure 12:
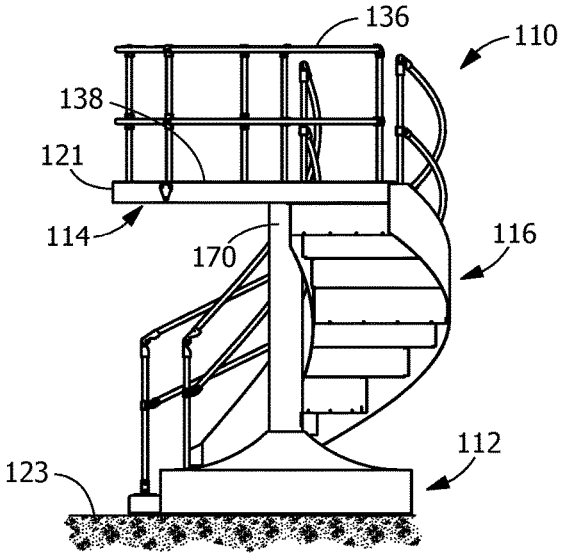
FIG. 12 is back view of the lifeguard observation station of FIG. 9.

A bottom step 180 of the stairs 116 is positioned such that a longitudinal axis or a longitudinal edge of the bottom step 180 is essentially parallel to the edge 122 of the pool or body of water 124 at which the lifeguard observation station member is positioned. As shown in FIGS. 9 and 10, the bottom step 180 is positioned spaced from the edge 122 of the pool 124, thereby allowing the lifeguard to step on the deck 123 of the pool 124 prior to entering the pool 124. In other embodiments, the bottom step 180 is positioned proximate to or in-line with the edge 122 of the pool 124, thereby allowing the lifeguard to enter the pool 124 directly from the bottom step 180.

As shown in FIG. 9, when viewed from the edge 122 of the pool or body of water 124, the stairs 116 are offset from the support post 170 to allow a lifeguard using the stairs to have unobstructed line-of-sight of the pool or body of water 124 as the lifeguard descends the stairs 116 from the platform member 114.

Continuous and unimpaired observation of the pool or body of water 124 are critical as the lifeguard is descending from the deck 138 of the platform member 114 to the edge 122 of the pool or body of water 124. Such unimpaired line-of-sight can be critical to allow a lifeguard to maintain a continuous vision of an impaired swimmer. In addition, the safety of the lifeguard ascending and descending the from the deck 138 are essential. The lifeguard observation station 110, and in particular, the stairs 116 are OSHA compliant.

While the invention has been described with reference to a preferred embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials and components, without departing from the spirit or essential characteristics thereof. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A lifeguard observation station for allowing a lifeguard to monitor a pool and swimmers or bathers therein, the lifeguard observation station comprising:

a weighted base, the weighted base having a base edge configured to be positioned proximate to a pool edge of the pool;

a support member extending from the weighted base, the support member having reinforcing members;

a platform member extending from the support member and above the weighted base, the reinforcing members engage the platform member to support the platform member and the lifeguard positioned on the platform member, the platform member having a first edge, with at least a portion of the first edge of the platform member and a portion of the platform member adjacent the first edge configured to extend to or beyond the pool edge of the pool, the base edge is offset from the first edge of the platform member;

wherein the first edge of the platform member is configured to extend over the pool edge when the base edge is positioned proximate the pool edge; stairs, the stairs extending from the platform member to a deck of the pool when the movable lifeguard observation station is positioned proximate the swimming pool;

wherein the portion of the platform member adjacent the first edge is configure to locate the lifeguard at the pool edge or over water in the pool to provide the lifeguard an unimpaired line-of-sight to the swimmers or bathers in the pool, and at the pool edge.

2. The lifeguard observation station as recited in claim 1, wherein the platform member has a volute shape.

3. The lifeguard observation station as recited in claim 1, wherein the platform member has a railing provided about a circumference thereof, including on the first side of the platform member which is configured to be positioned proximate to or in-line with the pool edge.

4. The lifeguard observation station as recited in claim 1, wherein a bottom stair of the stairs has a longitudinal axis which is essentially parallel to the pool edge when the movable lifeguard observation station is positioned proximate the pool.

5. The lifeguard observation station as recited in claim 4, wherein the bottom stair is positioned proximate to or in-line with the pool edge when the movable lifeguard observation station is positioned proximate the pool.

6. The lifeguard observation station as recited in claim 4, wherein the support member is offset from the stairs to allow the lifeguard to have a line-of-sight to the swimmers or bathers in the pool as the lifeguard is descending the stairs.

7. A movable lifeguard observation station for allowing a lifeguard to monitor a swimming pool and swimmers or bathers therein, the movable lifeguard observation station comprising:

a weighted base, the weighted base having a base edge configured to be positioned proximate to a pool edge of the pool;

a support member extending from the weighted base, the support member having reinforcing members;

a raised platform having a first edge, with at least a portion of the first edge of the raised platform and a portion of the raised platform adjacent the first edge configured to extend to or beyond the pool edge of the swimming pool, wherein the first edge and the portion of the raised platform adjacent the first edge configured to extend over water in the swimming pool, the base edge is offset from the first edge of the platform member;

stairs extending from the raised platform to a deck of the swimming pool when the movable lifeguard observation station is positioned proximate the swimming pool;

wherein the first edge of the platform member extends over the pool edge when the base edge is positioned proximate the pool edge;

wherein when the movable lifeguard observation station is positioned proximate the swimming pool, the movable lifeguard observation station provides the lifeguard an unimpaired line-of-sight to the swimmers or bathers in the swimming pool whether the lifeguard is positioned on the raised platform or on the stairs.

8. The movable lifeguard observation station as recited in claim 7, wherein a bottom stair of the stairs has a longitudinal axis which is essentially parallel to the pool edge at which the lifeguard observation station member is positioned when the movable lifeguard observation station is positioned proximate the swimming pool.

9. The movable lifeguard observation station as recited in claim 7, wherein a bottom stair of the stairs has a longitudinal axis which is essentially parallel to the first edge of the platform member.

10. The movable lifeguard observation station as recited in claim 8, wherein the bottom stair is positioned proximate to or in-line with the pool edge when the movable lifeguard observation station is positioned proximate the swimming pool.

11. The movable lifeguard observation station as recited in claim 8, wherein the support member is offset from the stairs to allow the lifeguard to have a line-of-sight to the swimmers or bathers in the swimming pool as the lifeguard is descending the stairs when the movable lifeguard observation station is positioned proximate the swimming pool.

12. The movable lifeguard observation station as recited in claim 11, wherein the raised platform has a volute shape with a railing provided about a circumference thereof, including on the portion of the first edge of the raised platform which extends beyond the pool edge of the swimming pool when the movable lifeguard observation station is positioned proximate the swimming pool.

13. The movable lifeguard observation station as recited in claim 8, wherein the weighted base has a ballast to provide additional stability to the lifeguard observation station.

* * * * *